US007140052B2

(12) United States Patent
Monestier et al.

(10) Patent No.: US 7,140,052 B2
(45) Date of Patent: Nov. 28, 2006

(54) FURNITURE COMBINATION BED AND DESK

(76) Inventors: Juan Carlos Monestier, Jose Ellauri 1086 Ap402, 11300 Montevideo (UY); Alejandro Monestier, José Ellauri 1086 Ap402, 11300 Montevideo (UY)

( * ) Notice: Subject to any disclaimer, the term of this patent is extended or adjusted under 35 U.S.C. 154(b) by 84 days.

(21) Appl. No.: 10/489,495

(22) PCT Filed: Sep. 4, 2002

(86) PCT No.: PCT/IB02/03666

§ 371 (c)(1),
(2), (4) Date: Mar. 12, 2004

(87) PCT Pub. No.: WO03/024279

PCT Pub. Date: Mar. 27, 2003

(65) Prior Publication Data

US 2005/0229307 A1 Oct. 20, 2005

(30) Foreign Application Priority Data

Sep. 14, 2001 (UY) ..... U 3860

(51) Int. Cl.
*A47C 17/52* (2006.01)

(52) U.S. Cl. ..... 5/2.1; 5/136; 5/160

(58) Field of Classification Search ..... 5/2.1, 5/136, 160, 164.1, 159.1
See application file for complete search history.

(56) References Cited

U.S. PATENT DOCUMENTS

| | | | | |
|---|---|---|---|---|
| 1,542,766 | A * | 6/1925 | Hall | 5/133 |
| 2,257,625 | A * | 9/1941 | Thomas | 5/2.1 |
| 4,070,715 | A | 1/1978 | Reppas | |
| 4,318,195 | A * | 3/1982 | Reppas | 5/2.1 |
| 4,564,964 | A * | 1/1986 | Pardo Herrera | 5/164.1 |
| 6,401,276 | B1 * | 6/2002 | Sherman | 5/136 |
| 6,691,342 | B1 * | 2/2004 | Sherman | 5/136 |

FOREIGN PATENT DOCUMENTS

| | | |
|---|---|---|
| DE | 4318785 | 2/1995 |

* cited by examiner

*Primary Examiner*—Michael Trettel
(74) *Attorney, Agent, or Firm*—Brooks Kushman P.C.

(57) ABSTRACT

Improvement in Combination bed (4) and desk (3) is disclosed: an articulated parallelogram (6, 8, 10, 11) based system and mechanism that links bed frame (4) and desktop (3) to elements (6, 10) fixed to a wall (or support or furniture body). Bed rotates as a wallbed, and desktop goes down and up always leveled. In raised position, bed lies against the wall, bedding concealed, and cantilever desktop at standard height rests against bed bottom. In the lowered position, the bed is deployed at normal height and desktop goes underneath at floor level. Desktop can admit objects as a PC monitor (up to 0.4 m height) that can remain undisturbed through conversion and stowing.

16 Claims, 4 Drawing Sheets

FURNITURE COMBINATION BED AND DESK

TECHNICAL FIELD

This invention relates to transformable furniture, single units that can fulfill alternatively more than one function. This application is for an improvement in Combination Bed and Desk furniture in Combination that allows objects to remain on the desktop.

BACKGROUND ART

The wall bed, (or Murphy Bed, a 1900 patent), a well known piece of furniture, allows a double use of a certain area of a room. It usually has a very simple mechanism, which includes springs to balance the weight and diminish effort for stowing or deploying the bed. Some versions become a Combination Bed and Desk, adding a folding desktop that can be deployed when the bed is stowed in a vertical position. The desktop must be cleared to stow it, and then the bed can be deployed. The desktop normally uses part of the area that the bed was occupying.

A great number patents combine a bed and a desk in fixed positions or folding the bed to stow it, but, few designs exist that can stow a loaded desktop and deploy a bed in the same area.

Similar existing proposals are compared with our invention as follows: Patent U.S. Pat. No. 4,070,715 dated Jan. 31, 1978, proposes a Combination Bed and Desk which consists of a wall bed and a desk that moves down and up.

The mechanism used is complex, having chains, pinions, shafts, racks and it almost always needs a motor. When the desk lowers from the use position, a mechanism keeps the desktop leveled thus allowing objects to remain on it. Simultaneously, the bed that was stowed against the wall turns, deploying at a normal level. Strokes only permit a reduced height for objects left on the desktop.

The bed land the desk, the main components of the furniture, when in use, come in turn to occupy the same floor area. The height of the desktop and the bed are normal in their use positions. In comparison, our design has only two or three pairs of simple auxiliary parts, with remarkable cost and simplicity advantage.

In summary, the system is different, stowed positions and mechanical means used are different.

Patent DE 4318785, issued Feb. 9, 1995, proposes a Combination Bed and Desktop without an additional furniture body unit. The described mechanism guides bed and desktop, linking bed and desktop to some wall fixed elements. The weight of moving parts and mechanism lever action is handled by four wheels that roll on the floor. In final stowed position, the bed lies flat against the wall with one side next to the floor. This mechanism is more complex than ours: it has five pairs of parts (or six or more according to the criteria), and also requires adequate quality of the floor for the wheels rolling on it. If floor lacks the required quality, some work should be done to it, or additional rails must be installed. Moreover, its main links are much longer and loaded in flexion, so our design has greater rigidity and solid feel for the user. Our design has only two or three pairs of simple auxiliary parts, with a remarkable cost and simplicity advantage.

In summary, the '785 system is different, the stowed positions and the mechanical means used are different.

BEST MODE OF CARRYING OUT THE INVENTION

Figure 2:
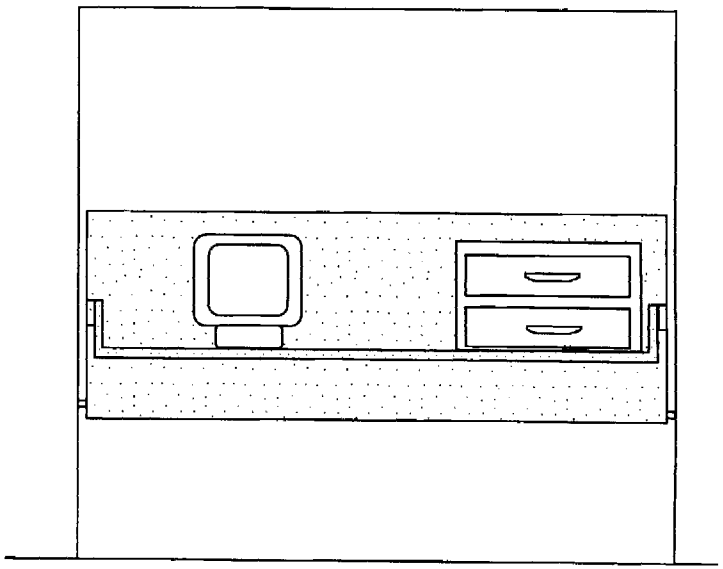
FIG. 2 is a front view with the stowed bed and the desktop in the use position.
Figure 1:
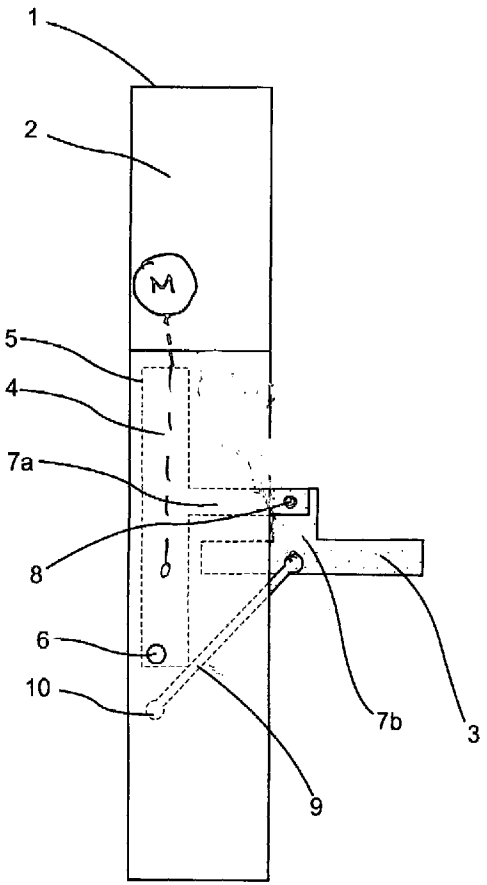
FIG. 1 is a side view of the present invention with the stowed bed and the desktop in the use position.
Figure 4:
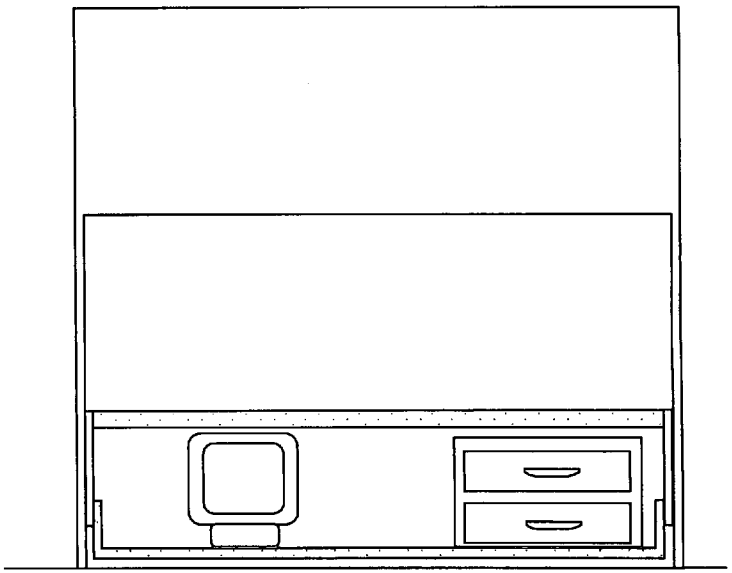
FIG. 4 is a front view with the bed deployed and the desktop stowed. (located underneath the bed)
Figure 3:
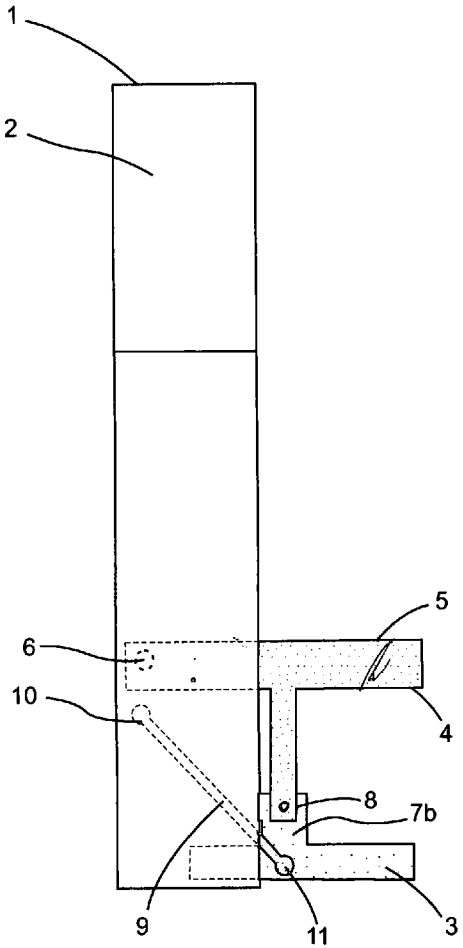
FIG. 3 is a side view with the bed deployed and the desktop stowed. (located underneath)
Figure 6:
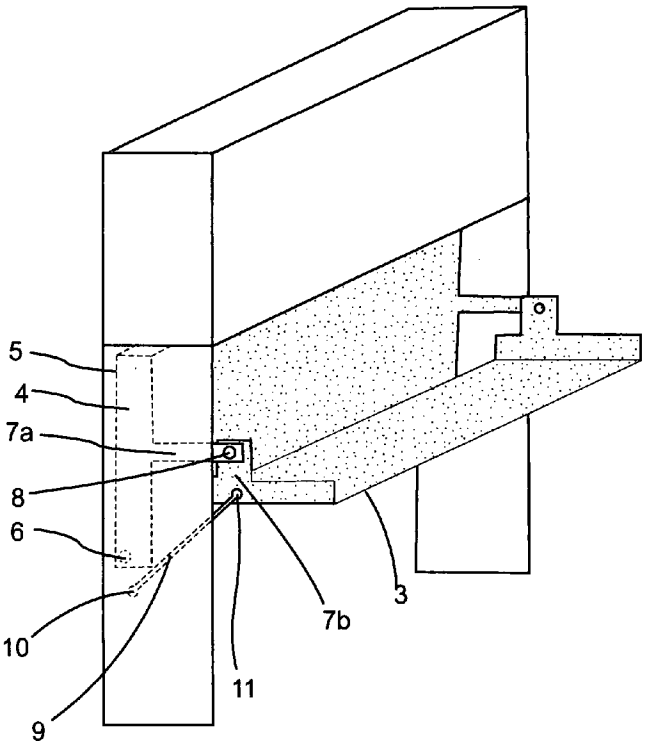
FIG. 6 is a perspective view with the stowed bed and the desktop in the use position.
Figure 5:
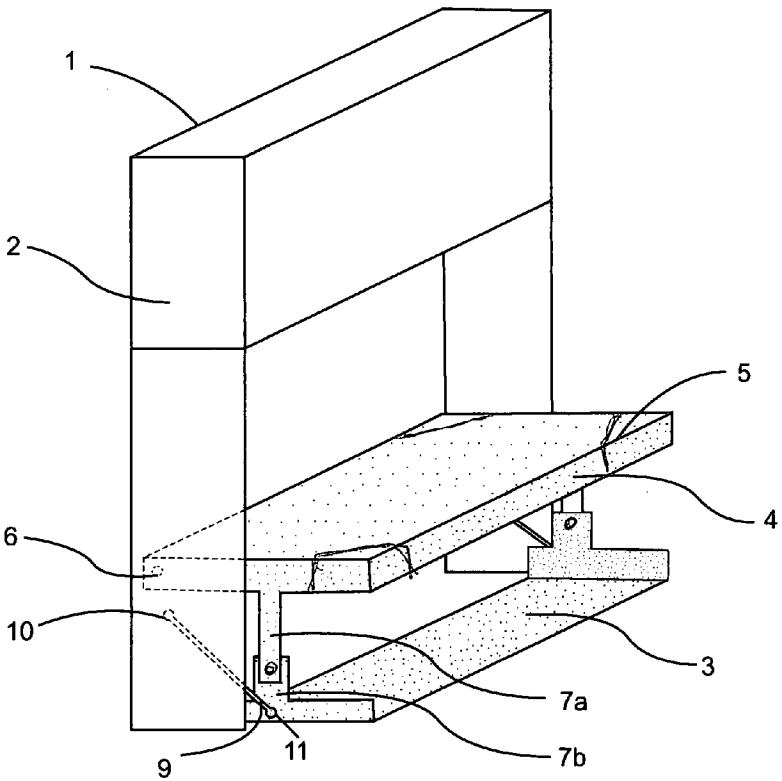
FIG. 5 is a perspective view with the bed deployed and the desktop stowed. (located underneath the bed)

The nature of this invention permits the use of well known metal and carpentry technologies and manufacturing processes.

DISCLOSURE OF INVENTION

Furniture Body and Linkage

See FIGS. 1, 2, 3, 4, 5, and 6.

The furniture has a body (1) which the upper part (2) is a cupboard or other storage. The mean and lower parts hold a desktop (3) and a bed frame (4) with a mattress and bedding (5). When in the desktop position, the bed lies flat against the back of the furniture (or against the wall if the furniture lacks a back), and the bedding is concealed from view. The desktop is supported in a cantilever position, its back edge resting against the bed bottom. When transformed into a bed, the desktop is guided downwards always leveled, and the bed deploys rotating at (6). The furniture has two symmetrical linkages for guiding, and, for the sake of simplicity, numbers refer only to one linkage. The bed and desktop articulates at (8) through head arms (7A) and (7B). A connecting rod (9) is parallel and of equal active length to the imaginary defined segment articulations (6) and (8). This connecting rod (9) articulates at (10) with body, articulation (11) guides the desktop. A parallelogram is thus formed by points (6), (8), (10) and (11), so the desktop is maintained level throughout its stroke. The parallelogram could be completely built in metal, and the desktop heads fixed to each corresponding side. This and other executions are variations that correspond to the same invention.

For aesthetic or practical reasons, connecting rod (9) can be placed in other locations parallel positions to the indicated one, then always forming a parallelogram and requiring adequate arms of bed and table heads to reach connecting rod articulations. The same linkage can be employed if walls or auxiliary structures are used to give support, instead of a furniture body. A balancing system can be added to lessen the efforts when changing from desktop to bed or conversely. The balancing force has to neutralize the weight of the desktop and bed with its contents, and can use any device like such as springs, torsion bar, gas springs, counterweights, etc. acting directly or by levers or cables etc. The numerous mechanical variations that can be used for balancing, do not affect the unit of invention of the present request.

The balance for direct manual conversion has to be precise to facilitate operation throughout the entire stroke.

After the balancing is adjusted, a ballast can be added to maintain balance when weighty objects are removed from the desktop or bed. Motorizations (M) can be used, electrical or mechanical (handle, pedal, etc.), in order to raise and lower components easily, reducing the necessity for exact balance. In this case, the balancing requirements are not so precise and the use of a ballast may no longer be necessary.

Balancing Mechanism Preferred Embodiment

Figure 7:
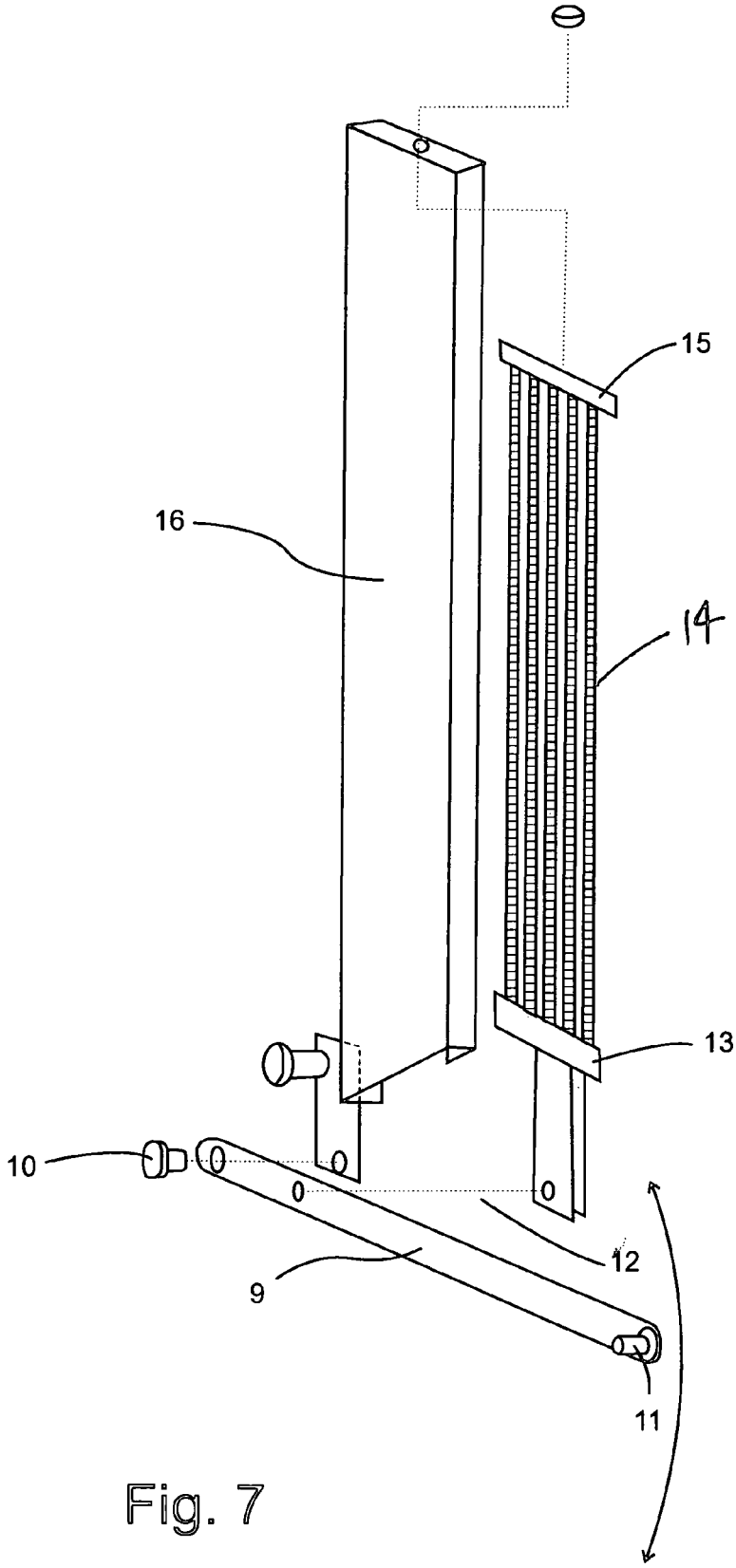
FIG. 7 is an exploded view of the balancing mechanism.

A balancing mechanism is added in this application and explained in FIG. 7.

The mechanism includes two symmetrical units (left and right), each unit affixed to the internal face of each side (or to another support). References are made to one unit for simplicity. The unit has a turning element (6) and a connecting rod (9) necessary to guide the bed and desk, respectively. Each unit has a vertical (or near) box (16) that contains springs (14) the upper ends are held by a part (15) fixed to box (16) that can be displaced to increase working tension. The lower ends of springs, by means of a part (13), applies force at point (12) to the (connecting rod) (9) which turns at (10). This connecting rod (9) guides the desktop, at point (11), and also balances the moving parts as explained.

This design makes it possible to match the force to the effect of gravity on the suspended parts throughout its entire stroke by means of a determination of components dimensioning obtained by applicable equilibrium algorithms. The quality of this mechanism contributes decisively to achieve an effortless direct manual conversion.

Bedding Stowing

The bedding needs no straps or similar elements to maintain its position. This is due to the turning limitation of the bed and the confinement in which it is left when it reaches a vertical position, together with an appropriate lateral compression of the mattress as lodged in the bed.

Minimum Area Model

A variation is to use a desktop of a shorter length than the bed. With similar conditions of support, the desktop occupies only a portion of the area previously used by the bed, so that some floor area remains available for other elements like drawers or shelves. Also, such an element can serve as a stool, and an internal face of the furniture or an adjacent wall can serve as a back to conform to a seat and which serves to work comfortably without any auxiliary element. This arrangement has the best floor use.

The invention claimed is:

1. A Combination bed and desk furniture item which can be transformed between a desk use position, comprising a bed stowed in a vertical non-use position, and a desk having a horizontal surface extending away from the bed, a bed use position in which the bed is horizontal and, the desk is stowed horizontally beneath the bed next to the floor, the bed pivotally connected to a fixed support, and a desk pivotally connected to the bed, the desk also being guided by connecting rods each having two spaced apart ends with one end pivotally connected to the desk and the other end pivotally connected to the fixed support, wherein the desk remains horizontal while moving between and when reaching the desk and bed use positions, this arrangement of said combination furniture item forming a parallelogram linkage, wherein the parallelogram comprises:

a first substantially upright imaginary side formed by the fixed support;

a rotatable second adjacent imaginary side formed by the bed, a third imaginary side, opposite to the first one, formed by the desk, which remains parallel to the first fixed side during the movement, a rotatable fourth side formed by the connecting rod linking a point on the desk forming the third imaginary and the furniture support.

2. A Combination bed and desk furniture item of claim 1, further comprising a spring for balancing the moving parts relative to the fixed support.

3. A Combination bed and desk furniture item of claim 2, further comprising storage components.

4. A Combination bed and desk furniture item of claim 2, further comprising a motor which moves the moving parts relative to the fixed support to carry out the transformation.

5. A Combination bed and desk furniture item of claim 2, wherein the bed is provided with a suitable confinement of bedding that allows not using auxiliary elements to maintain it in its place when the bed is turned for conversion to be stowed vertically and is brought back.

6. A Combination bed and desk furniture item of claim 1, further comprising storage components.

7. A Combination bed and desk furniture item of claim 6, further comprising a motor which moves the moving parts relative to the fixed support to carry out the transformation.

8. A Combination bed and desk furniture item of claim 6, wherein the bed is provided with a suitable confinement of bedding that allows not using auxiliary elements to maintain it in its place when the bed is turned for conversion to be stowed vertically and is brought back.

9. A Combination bed and desk furniture item of claim 1, further comprising a motor which moves the moving parts relative to the fixed support to carry out the transformation.

10. A Combination bed and desk furniture item of claim 9, wherein the bed is provided with a suitable confinement of bedding that allows not using auxiliary elements to maintain it in its place when the bed is turned for conversion to be stowed vertically and is brought back.

11. A Combination bed and desk furniture item of claim 1, wherein the bed is provided with a suitable confinement of bedding that allows not using auxiliary elements to maintain it in its place when the bed is turned for conversion to be stowed vertically and is brought back.

12. A Combination bed and desk furniture item which can be transformed between a desk use position, comprising a bed stowed in a vertical non-use position, and a desk having a horizontal surface extending away from the bed, a bed use position in which the bed is horizontal and, the desk is stowed horizontally beneath the bed next to the floor, the bed pivotally connected at to a fixed support, and a desk pivotally connected to the bed, the desk also being guided by connecting rods each having two spaced apart ends with one end pivotally connected to the desk and the other end pivotally connected to the fixed support, wherein the desk remains horizontal while moving between and when reaching the desk and bed use positions wherein the desk is spaced from the fixed support a substantially equal distance in the desk and use positions, this arrangement of said combination furniture item forming a parallelogram linkage, wherein the parallelogram comprises:

a first substantially upright imaginary side formed by the fixed support;

a rotatable second adjacent imaginary side formed by the bed, a third imaginary side, opposite to the first one, formed by the desk, which remains parallel to the first fixed side during the movement, a rotatable fourth side formed by the connecting rod linking a point on the desk forming the third imaginary and the furniture support.

13. A Combination bed and desk furniture item of claim 12, further comprising a spring for balancing the moving parts relative to the fixed support.

14. A Combination bed and desk furniture item of claim 12, further comprising storage components.

15. A Combination bed and desk furniture item of claim 12, further comprising a motor which moves the moving parts relative to the fixed support to carry out the transformation.

16. A Combination bed and desk furniture item of claim 12, wherein the bed is provided with a suitable confinement of bedding that allows not using auxiliary elements to maintain it in its place when the bed is turned for conversion to be stowed vertically and is brought back.

* * * * *